United States Patent [19]

Spadini et al.

[11] 3,963,649

[45] June 15, 1976

[54] LIQUID DETERGENT COMPOSITION

[75] Inventors: Gianfranco Luigi Spadini, Strombeek-Bever; Bob Dekker, Beigem, both of Belgium

[73] Assignee: The Procter & Gamble Company, Cincinnati, Ohio

[22] Filed: Sept. 5, 1973

[21] Appl. No.: 394,589

[30] Foreign Application Priority Data

Sept. 11, 1972 Luxemburg ..... 66053
Oct. 9, 1972 Luxemburg ..... 66258

[52] U.S. Cl. ..... 252/546; 252/526; 252/527; 252/528; 252/547; 252/548; 252/DIG. 14

[51] Int. Cl.[2] ..... C11D 3/02; C11D 3/16

[58] Field of Search .... 252/547, 546, 548, DIG. 10, 252/DIG. 14, 117, 544, 526, 527, 528

[56] References Cited

UNITED STATES PATENTS

| | | | |
|---|---|---|---|
| 2,251,328 | 8/1941 | Ehret | 252/91 |
| 3,548,056 | 12/1970 | Eigen et al. | 424/171 |
| 3,704,228 | 11/1972 | Eckert et al. | 252/117 |
| 3,793,233 | 2/1974 | Rose et al. | 252/547 |
| 3,808,311 | 4/1974 | Olson et al. | 252/547 X |
| 3,813,349 | 5/1974 | Wolfson | 252/547 |
| 3,816,321 | 6/1974 | Kleinschmidt | 252/547 X |
| 3,898,186 | 8/1975 | Mermelstein et al. | 252/545 |

*Primary Examiner*—Thomas J. Herbert, Jr.
*Attorney, Agent, or Firm*—Forrest L. Collins; E. G. Gebhardt; T. H. O'Flaherty

[57] ABSTRACT

Liquid detergent compositions containing a nonionic surface-active agent and a gel-forming gelatin. The compositions minimize filming, streaking, and spotting of tableware and kitchen utensils washed in solutions of the compositions and dried in air without polishing by a towel.

16 Claims, No Drawings

LIQUID DETERGENT COMPOSITION

BACKGROUND OF THE INVENTION

The present invention relates to a liquid detergent composition especially suitable for dishwashing. Such compositions contain a nonionic surface-active agent and a gel-forming gelatin. In particular, it pertains to liquid detergent compositions designed for cleaning glassware, china, and glazed or vitreous articles that provide outstanding drainage characteristics, thus avoiding the need for towel-drying. Filming, streaking, and spotting of the washed, rinsed, and air-dried articles are thereby minimized.

The performance of a detergent composition for cleaning glasses, dishes, windows and other articles with a glazed surface is usually evaluated by the consumer in terms of shine and the absence of filming, streaking, and spotting. The liquid dishwashing detergent compositions presently on the market are designed to remove the soils from glasses, dishes, and other tableware and kitchen utensils. The detergent solution and redeposited soil residues are normally removed from the washed articles by rinsing and/or towelling the articles when they are still wet. If not rinsed and towel-dried, these residues dry upon the surfaces of the washed articles, leaving films, streaks, or spots.

Even when such articles are entirely clean but rinsed in plain water containing dissolved salts such as water hardness, spots and streaks can appear on the washed and rinsed surfaces upon evaporation of the water.

Towel-drying of washed articles, e.g., glasses and dishes, immediately after removal from the washing and rinsing solution, is undesirable from the standpoints of convenience and hygiene. Therefore, it is common practice simply to put the washed or washed and rinsed articles aside for draining and air-drying. Consequently, the cleaning efficiency of the product used, which the housewife may have visually appreciated at the end of the washing or rinsing cycle, is diminished due to the adherence of redeposited soil, residual dried detergent, and/or water hardness residues.

The cleaning of larger glazed surfaces as tiled walls also requires wiping or rinsing and wiping when still wet to avoid filming, streaking, and spotting. Wiping immediately after cleaning to avoid evaporation and consequently filming, streaking, and spotting is not always practical and requires a frequent interruption of the cleaning process. Therefore, the detergent composition used may be considered as not cleaning well because of the film, streaks, and spots left on the treated surfaces, although the soil may have been removed.

Attempts have been made to minimize the effect of detergent, soil, and/or water hardness residue deposition during air-drying by employing various additives at either the washing or rinsing stage of the cleaning cycle, by either complexing the water hardness salts, adding improved soil-suspending agents, or formulating special rinsing agents. The incorporated complexing and/or soil suspending agents in liquid detergent compositions create formulation difficulties, while the special rinsing agents have to be packed and applied separately.

Detergent compositions containing gelatin or hydrolyzed proteins and surface-active agents have been disclosed for purposes other than the prevention of film, streaks, and spots. In U.S. Pat. No. 3,548,056, issued Dec. 15, 1970, the described lotion or detergent composition contains partially degraded protein having a gel strength of zero Bloom grams to improve mildness to skin. Italian Patent Specification No. 862,247 and U.S. Pat. No. 3,704,228 disclose detergent compositions containing gelatin, but the compositions are not within the scope of the present invention with regard to composition or the benefit provided.

There is a continuing need, however, for compositions and methods which can be employed during dishwashing operations to improve the final dry appearance of washed and dried kitchen utensils and articles. If such compositions and methods are intended to be useful for conventional dishwashing soil removal operations, there is a continuing need for a compatible combination of materials which will simultaneously provide the surfactancy, sudsing, and mildness attributes of an acceptable dishwashing detergent composition as well as the anti-spotting and anti-filming benefits descibed above.

Accordingly, it is an object of the present invention to provide liquid detergent compositions which provide a clean, shiny, and spotless appearance to the surfaces of kitchen utensils or glossy surfaces such as glazed tile after such surfaces have been washed in said compositions and dried.

It is a further object of the present invention to provide aesthetically acceptable liquid detergent compositions for treating surfaces of kitchen utensils as described above, said compositions having the commercially acceptable dishwashing detergent composition attributes of proper surfactancy, sudsing, and mildness.

It has now been surprisingly found that a liquid detergent containing a small amount of water soluble gelatin having a molecular weight of at least 12,500, an isoelectric point between pH 4.5 and pH 9.2, and a gel strength of from about 25 to about 300 Bloom grams, and a nonionic surface-active detergent, provides outstanding washing and cleaning compositions especially suitable for cleaning glassware, china, and glazed or vitreous articles.

SUMMARY OF THE INVENTION

The liquid detergent composition of the instant invention comprises from about 2% to about 40% by weight of a water-soluble, organic, nonionic surface-active agent selected from the group consisting of:

1. tertiary oxides corresponding to the general formula $$R_1R_2R_3Y \rightarrow O \qquad (I)$$

wherein $R_1$ is a straight or branched, saturated or unsaturated, aliphatic hydrocarbon, hydroxyhydrocarbon, or alkyloxyhydrocarbon radical having in total from 8 to 24 carbon atoms; and $R_2$ and $R_3$ are each a methyl, ethyl, hydroxymethyl, or hydroxyethyl radical; and Y is an N or P;

2. amides corresponding to the general formula $$R_4{-}CO{-}N(H)_{m-l}(R_5OH)_{3-m} \qquad (II)$$

wherein $R_4$ is a saturated or unsaturated, aliphatic hydrocarbon radical having from 7 to 21 carbon atoms; $R_5$ represents a methylene or ethylene group; and m is 1, 2, or 3;

3. a condensation product of from about 3 to about 25 moles of an alkylene oxide, preferably ethylene or propylene oxide, and one mole of an organic, hydrophobic compound, aliphatic or alkyl aromatic in nature, the latter having from about 8 to about 24 carbon atoms;

or a mixture thereof; from about 0.1% to about 5% by weight of a water-soluble gelatin, having a molecular weight of at least 12,500, an iso-electric point between pH 4.5 and about pH 9.2 and a gel strength between 25 and 300 Bloom grams, and from about 5% to about 95% by weight water.

DETAILED DESCRIPTION OF THE INVENTION

The gelatin and the nonionic surface-active agents to be used in the formulation of a liquid detergent composition of this invention and the other ingredients which may be added thereto are described hereinafter. Unless specified otherwise, reference to salt refers to sodium, potassium, ammonium, trimethyl-, triethyl-, dimethyl-, diethyl-, trimethanol-, triethanol-, dimethanol- and diethanol ammonium salts.

Gelatin is a protein obtained by the hydrolysis of collagen in turn obtained by boiling skin, ligaments, bones, etc., with water. The gelatin molecules, like the molecules of other proteins, are large and complex, having an average molecular weight ranging from about 5,000 up to 200,000 and above. Gelatin molecules carry an electric charge when in alkaline or acidic solution and are thus amphoteric in character and have a specific iso-electric point, which depends mainly upon the processing conditions during manufacturing. Gelatins obtained by acid treatment have an iso-electric point generally between pH 7 and pH 9. Gelatins obtained by alkaline treatment have an iso-electric point generally between pH 4.6 and pH 5. With special treatment, gelatins having an iso-electric point as low as pH 4.5 and as high as pH 9.2 can even be obtained. By mixing gelatins having different iso-electric points, gelatin mixtures having an iso-electric point between pH 4.5 and pH 9.2 can be formulated.

The amount of water-soluble gelatin to be included in the liquid detergent composition of the present invention may vary between 0.1% and about 5% by weight, preferably between 0.2% and about 2% by weight, calculated on the total weight of the composition. Gelatin levels above 5% by weight have proven somewhat impractical in liquid detergent compositions because the resulting composition is viscous and thus difficult to pour and slow to dissolve.

The molecular weight of the water-soluble gelatin to be used in the liquid detergent composition of this invention must be above 12,500, preferably above 15,000, preferably between 25,000 and 80,000, and most preferably between 35,000 and 50,000, while the iso-electric point of the gelatin must be between pH 4.5 and pH 9.2, preferably pH 6 or higher, and most preferably between pH 7 and pH 9, while the gel strength of the gelatin used must be above 25 Bloom grams, preferably above 50, most preferably between 80 and 200 Bloom grams. Gel strength in Bloom grams or Bloom strength is the force in grams to be applied on a cylinder, diameter 12.7 mm, on the free surface of a gel of 6.67% gelatin having a 15% humidity, to force it 4 mm into the gel. The standard testing procedure used to derive this parameter is set forth in detail in numerous references. Among such references are *Standard Methods for the Sampling and Testing of Gelatins*, Gelatin Manufacturers Institute of America, Inc., 501 Fifth Avenue, Room 1014, New York 17, N.Y., and "Standard Methods for Determining Viscosity and Jelly Strength of Glue," *Industrial and Engineering Chemistry*, Volume 16, No. 3, pages 310–315, both references herein incorporated by reference. Gelatin material operable in the instant invention is described in great detail in "Gelatin", *Encyclopedia of Chemical Technology*, Volume 10, John Wiley & Sons, Inc., pages 499–509 and R. H. Bogue, *The Chemistry and Technology of Gelatin and Glue*, McGraw Hill Book Co., Inc., 1922, both references incorporated herein by reference.

Suitable, water-soluble, nonionic surface-active agents to be used in the formulation of the liquid detergent composition of the present invention are:

1. water-soluble, nonionic, tertiary amine oxides as represented hereinafter by the general formula $$R_1R_2R_3Y \rightarrow O \qquad (I)$$

whereby Y represents an N-atom, the arrow is a conventional representation of a semi-polar bond; $R_1$ represents a high molecular, straight or branched, saturated or unsaturated, aliphatic hydrocarbon, hydroxyhydrocarbon, or alkyloxyhydrocarbon radical, preferably an alkyl radical, having in total 8 to 24, preferably 12 to 18, most preferably 12 carbon atoms, or a mixture of dodecyl with decyl and tetradecyl radicals, whereby at least 50% of the radicals are dodecyl; $R_2$ and $R_3$, which may be the same or different, represent each a methyl, ethyl, hydroxymethyl, and hydroxyethyl radical.

They are generally prepared by direct oxidation of appropriate tertiary amines, according to known methods. Specific examples of tertiary amine oxides are: dimethyl dodecyl amine oxide, diethyl tetradecyl amine oxide, bis-(2-hydroxyethyl)-dodecyl amine oxide, bis-(2-hydroxyethyl)-3-dodecoxy-1-hydroxypropyl amine oxide, dimethyl 2-hydroxy-dodecyl amine oxide, and diethyl eicosyl amine oxide;

2. water-soluble, nonionic, tertiary phosphine oxides as represented hereinafter by the general formula $$R_1R_2R_3Y \rightarrow O \qquad (I)$$

but whereby Y stands for a phosphorus atom, $R_1$, $R_2$ and $R_3$ have the same meaning as hereinbefore, and the arrow is a conventional representation of a semi-polar bond, and which can be prepared by alkylating an alkyl phosphine derivative and oxidizing said reaction product as described for example in the French patent specification No. 1,317,586. Specific examples of tertiary phosphine oxides are: dimethyl dodecyl phosphine oxide, diethyl tetradecyl phosphine oxide, bis-(2-hydroxyethyl)-dodecyl phosphine oxide, tetradecyl methyl 2-hydroxyethyl phosphine oxide, oleyl dimethyl phosphine oxide, and 2-hydroxydodecyl dimethyl phosphine oxide;

3. water-soluble amides as represented hereinafter by the general formula $$R_4{-}CO{-}N(H)_{m-1}(R_5OH)_{3-m} \qquad (II)$$

wherein $R_4$ is a saturated or unsaturated, aliphatic hydrocarbon radical having from 7 to 21, preferably from 11 to 17 carbon atoms; $R_5$ represents a methylene or ethylene group; and $m$ is 1, 2, or 3, preferably 1. Specific examples of said amides are mono-ethanol coconut fatty acid amide, diethanol dodecyl fatty acid amide, and dimethanol oleyl amide;

4. water-soluble condensation products obtained by condensing from 3 to about 25 moles of an alkylene oxide, preferably ethylene or propylene oxide, with one mole of an organic, hydrophobic compound, aliphatic or alkyl aromatic in nature, having 8 to 24 carbon atoms and at least one reactive hydrogen atom, preferably a reactive hydroxyl, amino, amido, or carboxy group. General examples are:

a. the condensates of ethylene oxide with aliphatic alcohols of more than 8 carbon atoms. The alcohols can be derived from the naturally occurring fatty acids, but also from various branched-chain higher alcohols. Among the preferred alcohol-ethylene oxide condensation products are those made from alcohols derived from tallow and coconut fatty acids. Most preferred are condensation products of about 4 to about 12 moles of ethylene oxide per mole of an aliphatic alcohol having from 10 to about 18 carbon atoms, in particular a middle-cut coconut fatty alcohol condensed with 6 moles of ethylene oxide;

b. condensates of ethylene oxide with alkylphenols, whereby the phenols may be mono- or polyalkylated and the total number of side-chain carbon atoms is as low as 5 to as high as 18 carbon atoms. The aromatic nucleus bearing the phenolic hydroxyl may be benzene, naphthalene, or diphenyl, preferably benzene. Specific examples are condensation products of one mole nonylphenol with 9 to 15 moles of ethylene oxide;

c. condensates of ethylene oxide with the fatty acid esters, preferably mono-fatty acid esters of the sugar alcohols, sorbitol and manitol, and, but less preferred, of di- and polysaccharides. Specific examples are the polyoxyethylene sorbitan-monolauric acid esters, having 20 and more ethylene oxide units; and the polyoxyethylene derivatives of fatty acid partial esters of hexitol anhydrides generally known under the trade name TWEEN; ICI America, Inc., Wilmington, Del.

d. polyethenoxy esters or esters by reacting ethylene oxide with carboxylic acids. The acids can be natural fatty acids or fatty acids made from oxidized paraffin wax, or mono- or polyalkylated benzoic and naphthenic acids. Preferred are aliphatic fatty acids having from 10 to 20 carbon atoms, and benzoic acids with 5 to 18 carbon atoms in the alkyl groups. Specific examples and preferred condensation products are tall oilethylene oxide and oleic acid-ethylene oxide condensation products having 9 to 15 ethylene oxide units;

e. condensation products of fatty acyl alkanolamides of the type $C_{7-17}$ alkyl—CO—$NHC_2H_4OH$, $C_{7-17}$ alkyl—CO—N—$(C_2H_4OH)_2$ with ethylene oxide. Preferred are condensation products of one mole coconut-CO—NH—$C_2H_4OH$ with 5 to 20 moles of ethylene oxide. Specific examples of polyethenoxy alkanolamides of fatty acids are the commercial products, marketed under the trade name ETHOMID; Armour Chemicals Co., Chicago, Ill.

f. condensation products of $C_{8-18}$ alkyl-, $C_{8-18}$ alkenyl- and $C_{5-18}$ alkylaryl amines and ethylene oxide. A specific and preferred example is the condensation product of one mole of a dodecylamine with 9–12 moles of ethylene oxide. Another specific example has the formula $C_{11-13}$alkyl—CO—NH—$C_6H_4$—$_N$—$[(OC_2H_4)_6OH]_2$.

The levels of nonionic surface-active detergent in the liquid detergent composition of the present invention should preferably not be higher than 40% by weight.

The attractiveness, efficacy and economy of the composition of the present invention can be improved, adapted or tailored to suit specific needs, by admixing water-soluble, organic, anionic, surface-active agents. The addition of anionic surface-active agents when added in given amounts to the liquid detergent composition of the present invention decreases the rinsing time needed to obtain effective drainage performance. Said phenomenon permits the formulation of liquid detergent compositions containing anionic surface-active agents in amounts up to about 40% by weight.

Suitable organic, synthetic, anionic surface-active agents which can be added or be present in the liquid detergent composition of the present invention are:

1. water-soluble hydrocarbon sulfates having the general formula $$R_6O(C_2H_4O)_nSO_3M \qquad \text{(III)}$$

wherein $R_6$ is a straight or branched, saturated or unsaturated, aliphatic hydrocarbon radical having from 8 to 22 carbon atoms; $n$ is from 0 to about 15; and M is a cation, preferably sodium or potassium. Important examples which form part of the preferred composition of the present invention are the salts of an organic, sulfuric acid reaction product of a saturated or unsaturated fatty alcohol having 8 to 18 carbon atoms, preferably tallow or coconut alcohol, reacted with 1.5 to 15, preferably 3 to 12 moles of ethylene oxide per mole of fatty alcohol. Specific examples are $C_{12-14}$ alkyl—O—$(C_2H_4O)_3$—$SO_3N(C_2H_4OH)_3$; coconut—O—$(C_2H_4)_4$—$SO_3Na$; $C_{14}$ alkyl—O—$(C_2H_4O)_3SO_3NH_4$; $C_{12-16}$ alkyl—O—$(C_2H_4O)_6$—$SO_2K$; and tallow—O—$(C_2H_4O)_9$—$SO_3N(H)(C_2H_4OH)_2$. Important examples of hydrocarbon sulfates as represented hereinbefore by the general formula (III) whereby $n$ is 0, are those obtained by sulfating hydroxylated hydrocarbons, preferably fatty alcohols having 8 to 18, most preferably 12 to 16 carbon atoms, with $SO_3$, $H_2SO_4$, etc., followed by hydrolysis and/or bleaching according to processes well known in the art;

2. water-soluble salts of the organic, sulfuric acid reaction products of the general formula $$R_7—SO_3M \qquad \text{(IV)}$$

wherein $R_7$ is chosen from the group consisting of a straight or branched, saturated or unsaturated, aliphatic hydrocarbon radical having from 8 to 24, preferably from 12 to 18 carbon atoms; and an alkylbenzene radical having from 8 to 18, preferably from 12 to 16 carbon atoms in the alkyl group; and M is a cation. Important examples of the synthetic detergents which form a part of the preferred compositions of the present invention are the salts of an organic, sulfuric acid reaction product of a hydrocarbon of the methane series, including iso-, neo-, meso-, and n-paraffins, having 8 to 24 carbon atoms, preferably 12 to 18 carbon atoms; or of a hydrocarbon of the ethylene series, having 8 to 20, preferably 12 to 18 carbon atoms, and 1 up to 4 double bonds, and a sulfonating agent, e.g., $SO_3$, $H_2SO_4$, oleum, obtained according to known sulfonation methods, including bleaching and hydrolysis. Preferred are sulfonated $C_{12-18}$ n-paraffins, alone or in combination with sulfonated alpha olefins containing in average 14 carbon atoms. Important examples of alkylbenzene sulfonates in which the alkyl group contains from about 9 to about 18 carbon atoms are dodecyl-, tetradecyl-, and hexadecylbenzene sulfonates and those described in the U.S. Pat. Nos. 2,220,099 and 2,477,383.

The maximum level of water-soluble, anionic surface-active agents that can be included in the liquid detergent composition of the present invention is conditioned by the level of nonionic surface-active agents present and also to a certain extent by the presence of the gelatin. The maximum amount of both nonionic and anionic surface-active agents which can be present in the composition of the present invention is about 48% by weight calculated on the total weight of the composition.

The preferred anionic, surface-active agent which can be included in the composition of the present invention, is the water-soluble hydrocarbon sulfate as represented hereinbefore by the general formula $R_6O(C_2H_4O)_nSO_3M$ (III), wherein $R_6$ is preferably straight, saturated, aliphatic hydrocarbon radical, having from 8 to 20, preferably 12 to 16 carbon atoms; $n$ is preferably from 1.5 to 12, most preferably from 3 to 9; and M is preferably sodium or potassium. Said preferred ethoxylated hydrocarbon sulfates can be present in amounts up to 40%, but preferably between 5 and 20% by weight, calculated on the total weight of the composition.

In case of combinations of water-soluble, ethoxylated hydrocarbon sulfates, as represented hereinbefore by the general formula $R_6O(C_2H_4O)_nSO_3M$ (III) and water-soluble salts of the organic, sulfuric acid reaction product of the general formula $R_7SO_3M$ (IV), wherein $R_6$, $R_7$, M and $n$ have the meaning indicated above; the weight ratio of said water-soluble salts of the organic, sulfuric acid reaction product to the sum of both the nonionic surface-active detergent and ethoxylated hydrocarbon sulfate should preferably be, dependent upon the concentration and type of the metal cations present in the washing solution (i.e., the ionic strength) at most 3:1, most preferably be below 1.5:1. Most preferred are those compositions whereby the water-soluble ethoxylated hydrocarbon sulfates are $C_{12-16}$ alkyl—O—$(C_2H_4O)_{3-6}SO_3M$, the water-soluble salts of the organic, sulfuric acid reaction products are $C_{12-18}$ paraffin sulfonates, the nonionic surface-active detergent is a mixture of $C_{12-14}$ alkyl-dimethyl amine oxide and coconut fatty acid diethanol amide, whereby the weight ratio of paraffin sulfonates to the sum of $C_{12-16}$ alkyl—O—$(C_2H_4O)_{3-6}SO_3M$ plus amine oxide and fatty acid diethanol amide is at most 2:1, preferably 1:1.

Since the detergent compositions of the instant invention exist in liquid form, such compositions can appropriately contain stabilizing agents such as certain hydrotropes to promote phase stability. Commonly employed hydrotropes include conventional lower alkylaryl sulfonates such as sodium and potassium toluene sulfonate, xylene sulfonate, benzene sulfonate and cumene sulfonate. Lower alkanol hydrotropes such as methanol, ethanol, propanol and butanol can also be employed as hydrotropes in the instant invention.

The hydrotropes generally comprise from about 1% to about 40%, preferably from about 2% to about 12% by weight of the total composition.

To improve the greasy soil emulsification, nonionic surface-active agents other than those that are essential components may be incorporated in the compositions of the invention. Examples are polyethylene glycol condensation products having a molecular weight of from about 160 to about 1200, and fatty acid esters, preferably mono-fatty acid esters of sugar alcohols, sorbitol and manitol. The amount of polyethylene glycol condensation products can be as high as 15% by weight. Amounts of 2 to 8% by weight are preferred. Incorporation of fatty acid esters of sugar alcohols is conditioned by their solubility and should preferably not exceed 3% by weight. Triethanolamine is another emulsifying agent which can be incorporated in compositions of the invention.

Another component that can be included in the composition of this invention is a water-soluble, low molecular, organic acid, or the water-soluble alkali-metal, ammonium-, and substituted ammonium salts thereof. Suitable water-soluble, low molecular, organic acids and salts thereof, including both the partially neutralized and completely neutralized salts, are for example acetic-, citric-, malic-, gluconic-, maleic-, lactic-, tartaric-, propionic-, butyric-, malonic-, polymaleic-, polyitaconic-, glutaric-, citraconic acid; benzene pentacarboxylic- and hexacarboxylic acid; succinic acid, ethylene diamine tetra-acetic acid and nitrilotriacetic acid. Said organic acids and/or the salts thereof are added to enhance the cleaning action of the liquid detergent composition of the present invention, and can, in addition, be used as a source of ions to keep the pH of the composition at a given pH value.

Specific examples of suitable, water-soluble, partially and completely neutralized, low molecular, organic acids are: mono-, di-, and trisodium citrate, diammonium citrate, monopotassium tartrate, disodium succinate, tetrasodium mellitate $C_6(COONa)_4(COOH)_2$.

The maximum level of said water-soluble, organic acids and/or salts that can be added to the liquid detergent composition of the present invention is not only conditioned by the level of the surface-active detergents present, but primarily by the presence of gelatin, and should not exceed 15% by weight calculated on the total weight of the composition, and should preferably be below 5% by weight. Some of said organic acid salts can be replaced by inorganic builder salts. The amount of inorganic builder salts, such as alkali metal phosphates, polyphosphates, carbonates, and borates should not exceed about 5% by weight.

Suitable other ingredients or additional compounds which can be added to improve consumer acceptance of the composition of the present invention are: perfumes, dyes, fluorescers, tarnish inhibitors such as benzotriazole or ethylene thio-urea, bactericides such as 2-bromo-2-nitro-1,3-propanediol, substituted benziodolium compounds, diphenyl ethers substituted with Cl, Br and/or —$CF_3$, e.g., 3,4-dichloro-4′-trifluoromethyldiphenyl ether, and organic solvents in amounts up to 15% by weight, to improve the pourability of the composition and to enhance the compatibility of different components, as for example $C_{2-8}$ mono- and dialcohols, e.g., ethanol, butanol, methyl-propanol-1 and -2, amylol or pentanol, butanediol as 1,2-, 1,3- and 1,4-butanediol, toluol, benzyl, carbinol, ethyleneglycol monobutyl ether, propyleneglycol propyl ether, and diethyleneglycol dimethyl ether.

The excellent cleaning and, in particular, the superior drainage performance of the liquid detergent composition of the present invention are illustrated in the following tests.

TEST A

Four series A, B, C, and D, each of five dishwashing solutions defined hereinafter, and three series A′, B′, C′, each of five rinsing solutions are prepared. Each dishwashing solution of each series contains 0.2% by weight per liter of a dishwashing composition as defined hereinafter. The rinsing solutions are plain tap water. The water of both the washing and rinsing solutions has a water hardness of about 3.4 millimoles of $CaCO_3$ per liter. Each washing and rinsing solution about 10 liters of water. The temperature of all washing solutions is about 52°C at the beginning and drops to between 42° and 35°C at the end of the washing cycle. The temperature of the rinsing solution is maintained between 17° and 19.5°C.

In each of said four series of five dishwashing solutions, ten soiled glasses (content: about 25 cl), obtained from a cafeteria, are immersed for 2 minutes, taken out one by one, rinsed one by one in the rinsing solution for one minute, and removed for draining and air-drying (room temperature: about 23°C.)

When the glasses are dry, four experienced graders individually compare the appearance of the glasses, comparing the set of ten glasses washed in the first washing solution of Series A and rinsed in the first rinsing solution of Series A′, with the set of 10 glasses washed in the first washing solution of Series B and rinsed in the first rinsing solution of Series B′; subsequently, with the set of ten glasses washed in the first washing solution of Series C and rinsed in the first rinsing solution of Series C′, etc., the set of 10 glasses washed and rinsed in the second washing and rinsing solution of Series A and A′ respectively, with the set of ten glasses washed and rinsed in the second washing and rinsing solution of Series B and B′ respectively, etc. The sets of 10 glasses washed in the five washing solutions of Series D are not rinsed but air-dried only. The appreciation of the graders as to the over-all appearance of glasses washed with compositions of the invention relative to control Series A is expressed in terms of much worse (− −), worse(−), equal (0), better (+), and much better (++). The results are tabulated in Table I.

TABLE I

| Series compared | 1st washing/ rinsing solution AB | AC | AD* | 2nd washing/ rinsing solution AB | AC | AD* |
|---|---|---|---|---|---|---|
| Grader 1 | + | ++ | 0 | + | ++ | − |
| 2 | + | ++ | − | ++ | + | − |
| 3 | ++ | ++ | 0 | ++ | ++ | − |
| 4 | + | ++ | − | + | ++ | 0 |

| 3rd washing/ rinsing solution AB | AC | AD* | 4th washing/ rinsing solution AB | AC | AD* | 5th washing/ rinsing solution AB | AC | AD* |
|---|---|---|---|---|---|---|---|---|
| + | ++ | 0 | + | ++ | − | ++ | + | − |
| ++ | ++ | 0 | + | + | 0 | ++ | ++ | 0 |
| + | ++ | 0 | + | ++ | 0 | ++ | ++ | 0 |
| + | ++ | − | + | ++ | − | + | ++ | − |

*Series D washed without rinsing

The liquid dishwashing compositions used in the Series A–D are formulated as follows:

| Ingredients | Series A | B | C | D |
|---|---|---|---|---|
| Paraffin sulfonate, ammonium salt (average MW of hydrocarbon radical: 196) | 10 | — | 10 | 10 |
| Coconut alcohol-ethylene oxide (3) sulfate, ammonium salt | 10 | — | 10 | 10 |
| Dimethyldodecylamine oxide | 4 | 4 | 4 | 4 |
| Coconut alcohol-ethylene oxide (6) condensate | 7 | 20 | 7 | 7 |
| Gelatin (average MW 25,000; isoelectric point about pH 8; Bloom strength about 100) | — | 1 | 1 | 1 |
| Coconut fatty acid diethanol amide | — | 2 | — | — |
| Water | | BALANCE | | |
| pH of the washing solutions | 7 | 7 | 7 | 7 |

The dishwashing composition of Series A is a representative of an efficient dishwashing cleaning agent. It is apparent as can be seen from Table I, that the glasses washed in the washing solutions of Series D (having the same composition as the washing solutions of Series A, except 1% by weight of gelatin) are not cleaner than those washed and rinsed in the washing and rinsing solutions of Series A and A′ respectively although the glasses washed and rinsed in the washing and rinsing solutions of B and B′ of C and C′ respectively are far superior in overall appearance over those washed and rinsed in washing and rinsing solutions A and A′ respectively.

TEST B

Four other Series E, F, G, and H, each of five dishwashing solutions are prepared, each containing 0.25% by weight per liter of a dishwashing composition, whereby the dishwashing solutions of Series E contain the dishwashing composition of Series A, those of Series F contain the dishwashing composition of Series B, those of Series G contain the dishwashing composition of Series C, and those of Series H contain the dishwashing composition of Series D, as described above. Also three series E′, F′, and G′ of rinsing solutions are prepared. The water used has the same hardness as in Test A. Each washing and rinsing container contains about 5 liters of water. The water is 10 cm high in each washing and rinsing container. The temperature of the washing solution is kept at about 42°C. The temperature of the rinsing solution varies between 30° and 35°C.

A set of four soiled, flat dishes (with glazed surface) obtained from a cafeteria, is washed in each of the five dishwashing solutions of each Series E, F, G, and H (80 dishes in total), removed from the washing solution and subsequently rinsed in the respective rinsing containers of each series (5 times successively immersed and removed from the container, except for the five sets of four dishes, each washed in the five dishwashing solutions of Series H. The dishes are then removed from the rinsing container for draining and air-drying.

The rinsing solution on the dishes washed and rinsed in the washing and rinsing solutions of Series F and F′ respectively and G and G′ respectively drains off within 60 seconds, while the water on the dishes washed and rinsed in the washing and rinsing solutions E and E′ respectively or washed in the washing solutions of Series H, only slowly disappears by evaporation, 10 to 12 minutes being necessary to obtain dry dishes.

When washing a set of four soiled dishes as described above, but rinsing them immediately under running tap water (approximately 16°C) instead of immersing them in the rinsing solutions, essentially the same drainage phenomenon is observed for the dishes washed in the washing solutions of Series F and G, while the dishes washed in the washing solutions of Series E and rinsed under running tap water are dry only after 10 to 12 minutes due to evaporation.

TEST C

Three Series K, L, M, each of five dishwashing solutions are prepared, containing 0.2% by weight per liter of dishwashing compositions formulated as indicated below. The water used has the same hardness as in Test A. The temperature of all washing solutions is maintained at 47°C. The temperature of the rinsing solution is between 30° and 36°C. Each washing or rinsing solution consists of 5 liters of water. The water is 10 cm high in each container.

In each of the five washing solutions of each Series K, L, M, a soiled dish, as described in Test B, is washed, removed from the washing solution and subsequently rinsed again in the same way as in Test B in the respective rinsing containers.

The dishwashing composition used in Series K has the same composition as that used in Series A of Test A; the liquid dishwashing composition used in Series L has the same composition as that used in Series B of Test A; the liquid dishwashing composition of Series M is identical to the liquid dishwashing composition used in Series B of Test A, except that 1% of a gelatin with an average molecular weight of about 5,000 (having 0 Bloom strength) is used.

The rinsing water on the dishes washed and rinsed in the washing and rinsing solutions of Series K and K′ respectively, M and M′ respectively, does not drain off but disappears slowly, mainly due to evaporation. The water on the dishes washed and rinsed in the washing and rinsing solutions of Series L and L′ respectively drains off within 60 seconds after removal from the rinsing bath.

The following examples serve to illustrate, but not to limit, the novel composition of the present invention. All percentages indicated are by weight.

| | EXAMPLES | | | | | | |
|---|---|---|---|---|---|---|---|
| | I | II | III | IV | V | VI | VII |
| Dimethyldodecyl amine oxide | 8% | 4% | 2% | 4% | 2% | 4% | 3% |
| Coconut alcohol ethylene oxide (6) condensate | 15 | 7 | 6 | 7 | 2 | 7 | 6 |
| Diethanol $C_{12-16}$ fatty acid amide | 2 | — | 3 | — | 2 | — | 2 |
| Coconut alcohol ethylene oxide (3) sulfate sodium salt | — | 10 | 9 | 14 | 10 | 12 | 14 |
| $C_{13-18}$ paraffin sulfonate sodium salt | — | 10 | 9 | — | 9 | 10 | 12 |
| $C_{12-14}$ alpha-olefin sulfonate ammonium salt | — | — | — | 12 | — | — | — |
| Triethanolamine | — | — | — | — | — | 5 | — |
| Boric acid | — | — | — | — | — | 2 | 1.5 |
| Gelatin* | 1 | 1 | 1 | 1 | 0.75 | 1 | 1 |
| Water | ——Balance—— | | | | | | |

*Gelatin: molecular weight 40,000; iso-electric point 8.4, Bloom strength about 100.

EXAMPLE VIII

A light duty liquid dishwashing detergent composition is prepared, by first mixing the surface-active agents in water and adding the gelatin subsequently while stirring. It has the following formulation:

| | |
|---|---|
| $C_{12}$ alkyl ethylene oxide (12) sulfate, potassium salt | 18.6% |
| dodecyl sulfate, potassium salt | 10 |
| dodecyl dimethyl amine oxide | 5 |
| gelatin (MW about 60,000; iso-electric point about 4.6; Bloom strength about 150) | 1.8 |
| potassium toluene sulfonate | 8 |
| water | balance |

Such a composition is effective for cleaning dishes and glasses, when utilized in a 02% aqueous solution. When so utilized, such a composition imparts shine to dishes and glasses after rinsing with water, and minimizes spotting and filming. Such a composition further has commercially acceptable sudsing and mildness characteristics.

Substantially similar dishwashing performance is obtained when the gelatin in the Example VIII composition is replaced with 1.2% by weight of gelatin, having a MW of about 80,000, an iso-electric point of about 4.8, and Bloom strength of 220.

EXAMPLE IX

| | |
|---|---|
| Coconut ethylene oxide (6) sulfate, sodium salt | 16.0% |
| Coconut alcohol sulfate, sodium salt | 11 |
| Coconut alkyl dimethyl amine oxide | 4.5 |
| Gelatin (MW about 70,000; iso-electric point about 6; Bloom strength about 200) | 1 |
| Potassium toluene sulfonate | 8 |

EXAMPLE IX-continued

| | |
|---|---|
| Water and Minors | Balance |

Such a composition is physically stable and is effective for cleaning china, glazed tiles, etc. when utilized in a 0.2% aqueous solution. Utilization of such a composition imparts shine to the items and minimizes filming and spotting thereof. Such a composition additionally has satisfactory sudsing and mildness characteristics.

Substantially similar dishwashing performance is obtained when the sodium coconut ethylene oxide (6) sulfate of the Example IX composition is replaced with an equivalent amount of potassium coconut ethylene oxide (12) sulfate, ammonium coconut ethylene oxide (12) sulfate, ammonium coconut ethylene oxide (6) sulfate, triethanolamine coconut ethylene oxide (6) sulfate or triethanolamine coconut ethylene oxide (12) sulfate.

Substantially similar dishwashing performance is obtained when the coconut alcohol sulfate sodium salt of the Example IX composition is replaced with an equivalent amount of coconut alcohol potassium and ammonium salt.

Substantially similar dishwashing performance is obtained when the coconut alkyl dimethyl amine oxide of the Example IX composition is replaced with an equivalent amount of dimethyldodecyl amine oxide, dimethyltetradecyl amine oxide or cetyldimethyl amine oxide.

Substantially similar dishwashing performance is obtained when in the above-described Example IX composition, the gelatin is replaced with 1.8% by weight of gelatin, having a MW of about 45,000, an iso-electric point of 4.6 and a Bloom strength of about 120, or 0.8% by weight of a gelatin having a MW of about 60,000, an iso-electric point of about 8.2 and a Bloom strength of about 180.

Substantially similar dishwashing performance and product stability are obtained when in the above-described Example IX composition, the potassium toluene sulfonate hydrotrope is replaced with an equivalent amount of potassium xylene sulfonate, potassium benzene sulfonate, potassium cumene sulfonate, sodium toluene sulfonate, sodium xylene sulfonate, sodium benzene sulfonate, sodium cumene sulfonate, methanol, ethanol, propanol, or n-butanol.

| EXAMPLE X | |
|---|---|
| Dimethyldodecyl amine oxide | 4.0% |
| Coconut alcohol ethylene oxide (6) condensate | 5 |
| Coconut alcohol ethylene oxide (3) sulfate, potassium salt | 10 |
| $C_{13-18}$ paraffin sulfonate, sodium salt | 8 |
| Coconut alcohol sulfate, potassium salt | 4 |
| Boric acid | 1.5 |
| Triethanolamine | 5 |
| Ethanol | 3 |
| Gelatin (MW 40,000 - iso-electric point 8.4; Bloom strength about 100) | 1 |
| Water | Balance |

| EXAMPLE XI | |
|---|---|
| Dimethyldodecyl amine oxide | 4.0% |
| Coconut alcohol ethylene oxide (6) condensate | 5 |
| Coconut alcohol ethylene oxide (3) sulfate potassium salt | 10 |
| $C_{13-18}$ paraffin sulfonate, sodium salt | 8 |

-continued

| | |
|---|---|
| Coconut alcohol sulfate, potassium salt | 4 |
| Sodium citrate | 1 |
| Boric acid | 1.5 |
| Triethanolamine | 5 |
| Ethanol | 5 |
| Gelatin (MW 40,000 - iso-electric point 8.4; Bloom strength about 100) | 1 |
| Water | Balance |

| EXAMPLE XII | |
|---|---|
| Dimethyldodecyl amine oxide | 4.0% |
| Polyethylene glycol - molecular weight 400 | 7 |
| Coconut alcohol ethylene oxide (3) sulfate, ammonium salt | 12 |
| $C_{12-14}$ alpha-olefin sulfonate, ammonium salt | 10 |
| Sodium acetate | 0.5 |
| Gelatin (MW 40,000 - iso-electric point 8.4; Bloom strength about 100) | 1 |
| Water | Balance |

| EXAMPLE XIII | |
|---|---|
| Dimethyldodecyl amine oxide | 4.0% |
| Coconut alcohol ethylene oxide (6) condensate | 10 |
| Tallow alcohol ethylene oxide (11) condensate | 6 |
| Diethanol $C_{12-16}$ fatty acid amide | 2 |
| Polyethylne glycol condensate - MW 400 | 4 |
| Gelatin (MW 25,000 - iso-electric point 8; Bloom strength about 60) | 1 |
| Water | Balance |

| EXAMPLE XIV | |
|---|---|
| Dimethyldodecyl amine oxide | 2.0% |
| Diethanol $C_{12-16}$ fatty acid amide | 2 |
| Coconut alcohol ethylene oxide (6) condensate | 2 |
| Polyethylene glycol condensate - MW 400 | 2 |
| Coconut alcohol ethylene oxide (6) sulfate, sodium salt | 7.5 |
| $C_{12-14}$ alkyl sulfate, sodium salt | 2.5 |
| $C_{13-18}$ paraffin sulfonate, sodium salt | 10 |
| Gelatin (MW 60,000 - iso-electric point 7; Bloom strength about 200) | 0.75 |
| Water | Balance |

What is claimed is:

1. A liquid dishwashing detergent composition comprising:

a. from about 2% to about 40% by weight of a water-soluble organic nonionic surface-active agent selected from the group consisting of:

1. tertiary oxides of the formula $$R_1R_2R_3Y \rightarrow O \quad (I)$$

wherein $R_1$ is a straight or branched, saturated or unsaturated, aliphatic hydrocarbon, hydroxyhydrocarbon, or alkyloxyhydrocarbon radical containing in total from 8 to 24 carbon atoms; and $R_2$ and $R_3$ are each a methyl, ethyl, hydroxymethyl, or hydroxyethyl radical; and Y is an N or P atom;

2. amides of the formula $$R_4—CO—N(H)_{m-1}(R_5OH)_{3-m} \quad (II)$$

wherein $R_4$ is a saturated or unsaturated, aliphatic hydrocarbon radical containing from 7 to 21 carbon atoms; $R_5$ represents a methylene or ethylene group; and $m$ is 1, 2, or 3;

3. a condensation product of from about 3 to about 25 moles of ethylene oxide and one mole of an organic, hydrophobic compound containing from about 8 to about 24 carbon atoms selected from the group consisting of $C_{10}$–$C_{18}$ aliphatic alcohols, mono- and poly-$C_5$–$C_{18}$ alkyl phenols, fatty acid esters of sorbitol, manitol and hexitol, $C_{10}$–$C_{20}$ aliphatic and $C_5$–$C_{18}$ alkyl aromatic carboxylic acids, $C_7$–$C_{17}$ mono- and dialkanolamides and $C_8$–$C_{18}$ alkyl- and alkenyl- and $C_5$–$C_{18}$ alkaryl amines;

and mixtures thereof;

b. from about 0.1% to about 5% by weight of a water-soluble gelatin, having a molecular weight of at least 15,000, an iso-electric point between about pH 4.5 and about pH 9.2; and a gel strength between 50 and 300 Bloom grams;

c. from about 5% to about 95% by weight of water.

2. The composition of claim 1, wherein said gelatin comprises from about 0.2% to about 2% by weight and has a molecular weight between 25,000 and 80,000.

3. The composition of claim 2 wherein said gelatin has an iso-electric point between pH 7 and pH 9, and a gel strength between 80 and 200 Bloom grams.

4. The composition of claim 1 wherein said water-soluble organic nonionic surface-active agent is a mixture of tertiary amine oxides and $C_{11-17}$ alkyl-CO-diethanol amides in a ratio of from about 5:1 to 1:2 by weight.

5. The composition of claim 1 which additionally comprises from about 2% to about 12% by weight of a stabilizing agent chosen from the group consisting of ethanol and alkali metal salts of toluene sulfonate, xylene sulfonate, benzene sulfonate, and cumene sulfonate.

6. The composition of claim 1 which additionally contains from about 1% to about 40% by weight of a water-soluble hydrocarbon sulfate of the formula $$R_6O(C_2H_4O)_nSO_3M \qquad \text{(III)}$$

wherein $R_6$ is a straight or branched, saturated or unsaturated, aliphatic hydrocarbon radical containing from 8 to 22 carbon atoms; $n$ is from 0 to about 15, and M is a cation, preferably sodium or potassium; whereby the total amount of nonionic surface-active agent and hydrocarbon sulfate is not more than 48% by weight of the total composition.

7. The composition of claim 6 containing from about 2% to about 30% by weight of said water-soluble hydrocarbon sulfate wherein $n$ is from about 3 to about 12.

8. The composition of claim 6 containing from about 2% to about 15% by weight of said water-soluble hydrocarbon sulfate wherein $n$ is 0.

9. The composition of claim 1 which additionally contains from about 1% to about 30% by weight of a water-soluble organic sulfuric acid reaction product of the formula $$R_7SO_3M \qquad \text{(IV)}$$

wherein $R_7$ is chosen from the group consisting of a straight or branched, saturated or unsaturated, aliphatic hydrocarbon radical containing from 8 to 24 carbon atoms; and an alkylbenzene radical containing from 8 to 18 carbon atoms in the alkyl group; and M is a cation, preferably sodium or potassium; wherein the total amount of nonionic surface-active agent and organic sulfuric acid reaction product is not more than 48% by weight of the total composition.

10. The composition of claim 9 containing from about 3% to about 15% by weight of said organic, sulfuric acid reaction product of the general formula $R_7SO_3M$ wherein the weight ratio of said organic sulfuric acid reaction product to said nonionic surface-active agent is below 3:1.

11. The composition of claim 9 wherein the organic, sulfuric acid reaction product is a $C_{12-18}$ n-paraffin sulfonate.

12. The composition of claim 10 which additionally contains a water-soluble hydrocarbon sulfate of the formula $R_6O(C_2H_4O)_nSO_3M$ wherein $R_6$ is a straight or branched, saturated or unsaturated, aliphatic hydrocarbon radical containing from 8 to 22 atoms, $n$ is from 0 to about 15 and M is a cation, preferably sodium or potassium; wherein the weight ratio of said organic sulfuric acid reaction product to the sum of nonionic surface-active agent and said hydrocarbon sulfate is below 1.5:1.0.

13. The composition of claim 12 wherein said gelatin comprises from about 0.5% to about 2% by weight, has an isoelectric point between pH 7 and 8.5, has an average molecular weight between 35,000 and 50,000, and a gel strength of 80 to 200 Bloom grams; said nonionic surface-active agent comprises from about 4% to about 16% by weight; said hydrocarbon sulfate comprises from about 2% to about 30% by weight and said organic sulfuric acid reaction product comprises from about 3% to about 15% by weight, wherein the weight ratio of said sulfuric acid reaction product to the nonionic surface-active agent is below 2.5:1.0 and the weight ratio of said sulfuric acid reaction product to the sum of nonionic surface-active agent and hydrocarbon sulfate is below 1.0:1.0.

14. The composition of claim 1 which additionally contains from about 1% to about 15% by weight of the total composition of a water-soluble, low molecular, organic acid or the water-soluble alkali metal, ammonium or substituted ammonium salts thereof.

15. The composition of claim 14 wherein the organic acid or water-soluble salt is selected from the group consisting of citric acid, tartaric acid, succinic acid, benzene hexacarboxylic acid, and ethylene diamine tetra-acetic acid and salts thereof.

16. The composition of claim 1 which additionally contains from about 2% to about 10% by weight of an emulsifying agent selected from the group consisting of polyethylene glycol condensation products having molecular weights from about 160 to about 1200; fatty acid esters, and triethanolamine.

* * * * *